US005690868A

United States Patent [19]

Strauss et al.

[11] Patent Number: 5,690,868

[45] Date of Patent: Nov. 25, 1997

[54] MULTI-LAYER HIGH ENERGY PROPELLANTS

[75] Inventors: Bernard Strauss, Rockaway; Thelma Manning, Montville; Joseph P. Prezelski, Budd Lake; Sam Moy, Parsippany, all of N.J.

[73] Assignee: The United States of America as represented by the Secretary of the Army, Washington, D.C.

[21] Appl. No.: 744,392

[22] Filed: Nov. 7, 1996

Related U.S. Application Data

[63] Continuation-in-part of Ser. No. 6,671, Jan. 19, 1993, Pat. No. 5,244,511.

[51] Int. Cl.[6] ..... C06B 21/00; C06B 45/10

[52] U.S. Cl. ..... 264/3.1; 149/19.9; 149/19.91; 149/19.92

[58] Field of Search ..... 264/3.1; 149/19.9, 149/19.91, 19.92

[56] References Cited

U.S. PATENT DOCUMENTS

| | | | |
|---|---|---|---|
| 5,460,669 | 10/1995 | Willer et al. | 149/92 |
| 5,467,714 | 11/1995 | Lund et al. | 102/284 |
| 5,468,313 | 11/1995 | Wallace, II et al. | 149/53 |
| 5,500,061 | 3/1996 | Warren et al. | 149/19.4 |
| 5,587,553 | 12/1996 | Braithwaite et al. | 149/19.6 |
| 5,591,936 | 1/1997 | Willer | 149/19.4 |

*Primary Examiner*—Peter A. Nelson

*Attorney, Agent, or Firm*—Michael C. Sachs; John E. Callaghan

[57] ABSTRACT

A multi-layer propellant and a method for making the same is provided, in which the propellant has at least one slow burning formulation and at least one fast burning formulation, such that the ratio of these burning rates is at least 2:1. The propellant produces an impetus of at least 1300 Joules/gm. The preferred binder is a high energy oxetane thermoplastic elastomer. The preferred slow burning formulation employs RDX, while the preferred fast burning formulation employs CL-20. The two formulations are formed separately, such as in layers that are then fused, using the bonding strength of the binder. The shape may be any shape that is useful in munitions and may include one or many layers of each burning rate. Preferred shapes include a multi-layered propellant with one slow burning formulation on top and a bottom layer of the fast burning formulation. The layers may be formed from ribbons, discs, cones, truncated cones and partial spheres. The amount of binder in each formulation should be sufficient to provide a uniformly dispersed oxidizer throughout the layer. Preferred amounts of binder range from about five percent to about thirty percent by weight, based on the total weight of the propellant.

4 Claims, No Drawings

MULTI-LAYER HIGH ENERGY PROPELLANTS

REFERENCE TO RELATED APPLICATION

This application is a continuation-in-part of application Ser. No. 08/006,671, filed on Jan. 19, 1993, and now U.S. Pat. No. 5,244,511.

The invention described herein may be manufactured, used, and licensed by or for the U.S. Government for U.S. Governmental purposes.

FIELD OF THE INVENTION

The present invention relates generally to an optimized gun propellant formulation using energetic thermoplastic elastomers and high energy oxidizers. More particularly the invention relates to a formulation in which a multi-layered propellant is provided in which at least two layers are employed, with at least one layer having a slow burn rate and at least one layer has a fast burn rate.

BACKGROUND OF THE INVENTION

As with the evolution of many technologies, new weapon systems require higher munitions performance. Current standard propellants do not have adequate energy to deliver the performance required for systems that are presently being developed. JA2, which is a standard double base propellant used, for example, in the M829A1 and M829A2 tanks rounds, has an impetus value of 1150 Joules/gram. M43, which is used in the M900A1 cartridge, has an impetus of 1181 J/g. Both of these conventional propellants do not have the energy level to deliver the muzzle velocity required in future high energy tank systems such as the M829E3. Theoretical calculations have shown that a propellant containing an energy above the 1300 J/g threshold is needed.

In addition to the energy content, it has been shown by theoretical calculations that the ballistic cycle can be optimized and work output can be maximized by using a combination of two equienergetic propellants whose burning rates are different by a factor of three or four. The slow burning propellant is designed to enter the cycle at a later time. Current standard propellants do not exhibit such wide variation in burning rates at a specified energy level. Standard tank gun propellants such as XM39, M43, M44 or JA2 have burning rate differentials that are, at best, less than two to one, and thus they are unsatisfactory for solving the problem of delivering much higher muzzle velocities. It would be a major advance in the art if an actual propellant could be provided to meet theoretical calculations.

Along with the inability to generate adequate energy levels, present day propellants produce volatile organic compounds and ancillary waste, especially in enhanced demil and recyclability. To meet the environmental requirements of the Environmental Protection Agency to reduce the emission of solvents into the atmosphere, the propellant binder must be extruded under non-solvent processing methods.

Accordingly, one object of the present invention is to provide high energy propellants that do not require a solvent when the propellant is extruded.

Another object of this invention is to provide a composition and method for incorporating two or more high energy explosives and propellants whose burning rate are dissimilar, and preferably at least 2:1.

Yet another object of this invention is to provide a composition having two or more high energy explosives and propellants whose combined total impetus value is at least 1300 Joules/gm.

Other objects will appear hereinafter.

SUMMARY OF THE INVENTION

It has now been discovered that the above and other objects of the present invention may be accomplished in the following manner. Specifically it has been discovered that two propellants of substantially different burning rates may be formulated with the same binder to produce a substantially improved multi-layer propellant.

The multi-layer propellant has at least one slow burning formulation and at least one fast burning formulation. The first formulation is extruded or cast from an admixture of a high energy elastomer binder and a slow rate oxidizer having a burning rate about that of RDX. The formulation is formed into at least one slow burn layer. Likewise, the second formulation is formed from an admixture having the same high energy elastomer binder and a fast rate oxidizer having a burning rate about that of CL-20. The second formulation is formed into at least one fast burn layer. The two or more thus formed layers are then bonding together into a single geometric shape. The layers are bonded together by said binder, normally by application of pressure once the layers have been placed in the desired shape. The binder provides structural integrity of the resulting multi-layer propellant.

The preferred binder is oxetane thermoplastic elastomer and the amount of binder in each formulation ranges from about five percent to about thirty percent by weight, based on the total weight of the propellant. More or less binder may be used as long as effective dispersion of the oxidants in the binder is achieved and the binder is able to bond to itself as the layers are pressed together.

The preferred multi-layer propellant does employ RDX as the slow rate oxidizer. The fast rate oxidizer is preferably CL-20, which thereby produces a the ratio of respective burning rates of at least 3:1. It is also within the scope of this invention to augment the fast rate oxidizer by including a second fast rate oxidizer selected from the group consisting of TNAZ, S-TNT, S-TNB, BTTN, TMETN, TEGDN, BDNPA/F, methyl NENA, ethyl NENA, and mixtures thereof. The multi-layer propellant should have an impetus of at least 1300 Joules/gm.

The method of formulating each of the two or more layers comprises the steps of melting the oxidizer at a temperature slightly above its melting point, normally about 10°–20° C. above the melting temperature. The high energy elastomer binder is then added to the molten explosive and the mixture is stirred sufficiently to completely dissolve and/or plasticize the binder. The molten solution is then reduced to a usable form, either by extrusion or melt casting into desired propellant shapes. A preferred multi-layered propellant includes one top layer of the slow burning formulation and at least one bottom layer of the fast burning formulation. The propellant layers may be formed from ribbons, discs, cones, truncated cones and partial spheres.

DETAILED DESCRIPTION OF THE PREFERRED EMBODIMENT

The present invention has many advantages over the prior art propellant formulations. In its simplest form, the invention comprises an oxetane thermoplastic elastomer energetic binder admixed with a high energy explosive filler. A plasticizer may be added in some applications.

The oxetane thermoplastic elastomer energetic binder is an essential part of the invention, and is available from Thiokol Corporation. Also known as BAMO/AMMO, the oxetane thermoplastic elastomer is energetic and is melted at moderate elevated temperature and then solidified into an elastomeric material. It is made from two types of monomers: 3,3-bis-azidomethyl-oxetane, or BAMO as a hard block, and 3-azidomethyl-3-methyloxetane, or AMMO as a soft block. It is capable of being re-melted at elevated temperatures to allow the binder to be processable with other propellant ingredients without the use of solvents, and this is a major advantage. In addition, the oxetane thermoplastic elastomer energetic binder has excellent mechanical properties that are superior to conventional propellants because of elastomeric characteristics, especially at cold temperatures such as −20° to −40° F. This binder also has other good mechanical properties that are important for uniform ballistic performance as well as having low vulnerability to shaped charge jet impact. It possesses adequate adhesive quality to self bond the two or more layers under appropriate contact and pressure.

The slow burn rate oxidant that is preferred is RDX, a staple explosive for present day munitions that do not require the higher energy rates of the most modern designs. HMX and other known slow burn rate oxidizers may also be used, as long as the burn rate is approximately that of RDX. Other oxidants may be used in combination with the RDX as long as the amount is not sufficient to substantially change the burning rate so that the desired ratio of fast to slow burn rates no longer is above 3:1.

The preferred high burn rate oxidizer is hexanitrohexaazaisowurtzitane or CL20. This oxidizer has been of considerable interest since its development, and produces a relatively fast burn rate. It, as is RDX, is soluble or plasticized with the oxetane thermoplastic binder by melting the oxidizer and admixing sufficient binder to form a uniform solution of oxidizer. Other high burn rate explosives may also be added, provided that they too are compatible and disperse properly in the formulations. Examples of other high rate oxidizers are, 1,3,3-trinitroazetidine or TNAZ, 2,4,6-trinitrotoluene or S-TNT, 1,3,5-trinitrobenzene or S-TNB, butane-trio-trinitrate or BTTN, trimethylolethane trinitrate or TMETN; triethylene glycol dinitrate or TEGDN, bis, 2,2-dinitro propyl acetal/bis 2,2-dinitro propyl formal or BDNPA/F, methyl nitrato ethyl nitramine or methyl NENA, ethyl NENA, mixtures thereof and the like.

Each of the two or more formulations are made separately by melting the oxidizer—either RDX or CL20, etc.—at a temperature slightly above the melting point of the oxidizer. Normally this temperature will be about 10°–20 C. above the oxidizer's melting temperature. The high energy elastomer binder is then added with mixing to the molten explosive to completely dissolve and/or plasticize the binder. The molten solution is then cooled slightly and formed in a shape, either by extrusion or melt casting into desired configuration.

Since all of the layers have the high energy binder present in an amount sufficient to form the desired dispersion, there is enough binder present to accomplish bonding between the layers under pressure. Once the layers are in the desired shape, they are combined to the proper configuration. Of course, care must be taken when combining layers so as to not damage the formulations. Graphite or other lubricating materials that do not otherwise adversely affect the propellant/binder mixtures may be sprayed or otherwise added to the surface, for example when two layers are pressed together by passing the layers between a pair of rollers. When the multi-layer formulations are first formed into discs, cones, spheres and the like, such as in a mold, lubricating materials such as graphite spray may be added to the mold surfaces or to the particular surfaces that will contact the mold surfaces or other components. While it has not been found necessary to add an adhesive to further strengthen the bond between the respective layers, such is within the scope of this invention and may be added as an additional step or component as desired.

A preferred multi-layered propellant includes one top layer of the slow burning formulation and at least one bottom layer of the fast burning formulation. As noted above, the propellant layers may be formed from ribbons, discs, cones, truncated cones and partial spheres. All that is required is that two burn rate formulations are bonded together in the appropriate shape for use in the intended munitions. Proper selection of oxidants as set forth above will produce a propellant with an impetus of at least 1300 Joules/cm.

In order to demonstrate the effectiveness of the method of this invention, the following examples were prepared. The preferred oxetane thermoplastic elastomer energetic binder of this invention was tested for thermal stability, both alone and with the preferred slow burn rate and fast burn rate oxidizers of this invention. Results of these tests are shown in Table I below.

TABLE I

| Sample | Self Heat, °C. | Ignition, °C. |
|---|---|---|
| OXETANE Only | 166 | 229 |
| OXETANE/CL20(1:1) | 181 | 206 |
| OXETANE/RDX(1:1) | 196 | 222 |

In order to demonstrate the effectiveness of the propellants of this invention, a number of formulations were mixed and extruded into layers and other shapes. The method of preparing the formulations comprised the steps of mixing at about 95° C. and extruding at slightly lower temperatures. Processing at these temperatures provided a safe operating margin of at least 50° C. because the self heat temperatures of the oxidant ranges from about 175° C. to 192° C. Formulations of slow burn rates using RDX and fast burn rates using CL20 and Oxetane binder were bonded using pressure and the intermixing of the Oxetane binder at the surfaces of the two layers. The impetus and ratio of fast/slow burn rates were measured. Presented below in Table II are the results of these comparisons.

TABLE II

| Sample | Slow burn | Fast burn | Ratio, @ 25 kpsi | Impetus J/g |
|---|---|---|---|---|
| A | RDX | CL20 | 2.7/1 | 1306 |
| B | RDX | CL20/76* | 4.8/1 | 1336 |
| C | JA2 | JAX | 1.2/1 | 1182 |
| D | RDX/CL20 | CL20/76* | 4.8/1 | 1320 |

*Sample also included 4% TNAZ as plasticizer.
**Sample is conventional JA2 propellant with RDX as the oxidant.

The next evaluation of these samples was to determine the burn rate at various conditions. The data for the burn rates, presented below in Table III, represent closed bomb data. As can be seen, RDX containing samples C and D have the slowest burning rates, which is comparable to the LOVA type M43 formulation. The CL-20 samples A and B have much faster burn rates, the improvement being about 2.7 times (Sample A) and 4.8 times at 25,000 psi (Sample B). Based upon this data, a combination of a first propellant having burning ratios at least two times faster than a second combined propellant is now possible. In comparison, the existing conventional system of JA2/JAX has a ratio of 1.2 times (Sample C).

TABLE III

| Sample | 10 kpsi | 15 kpsi | 25 kpsi |
|---|---|---|---|
| A | 4.5 | 6.9 | 11.8 |
| B | 4.6 | 9.0 | 21.0 |
| C | n/a | n/a | 7.5/8.8 |

To demonstrate the compatibility of the multi-layer propellant of this invention, a number of examples were prepared. Presented below are the formulations for slow burn and fast burn rate components.

TABLE IV

| FORMULATION | SLOW BURN | FAST BURN |
|---|---|---|
| 1 | OXETANE/RDX | OXETANE/CL20 |
| 2 | OXETANE/RDX/CL20 | OXETANE/CL20/TNAZ |

Both formulations were extruded into narrow ribbons with an approximate cross-sectional area of 0.8" wide by 0.1". Various laminated geometries were made, including a sandwich formed with two slow burn layers sandwiching a fast burn rate layer. These two formulations were also stamped into a disc configuration of ¾" diameter and 0.3" thickness. Fusion tests were performed by use of a standard tack test used by the tire industry. Various formulations were layered on top of one another, varying contact time and pressure to determine the subsequent bond strength as the layers were pulled apart at a 180° angle.

While particular embodiments of the present invention have been illustrated and described herein, it is not intended that these illustrations and descriptions limit the invention. Changes and modifications may be made herein without departing from the scope and spirit of the following claims.

We claim:

1. A method of making a multi-layer propellant having at least one slow burning formulation and at least one fast burning formulation, comprising:

forming a first formulation having a high energy elastomer binder and a slow rate oxidizer having a burning rate about that of RDX, said first formulation being formed into at least one slow burn layer; and forming a second formulation having the same high energy elastomer binder and a fast rate oxidizer having a burning rate about that of CL-20, said second formulation being formed into at least one fast burn layer;

bonding said at least one slow burn layer and at least one fast burn layer into a single geometric shape such that said layers are bonded together by said binder to provide structural integrity of the resulting multi-layer propellant.

2. The method of claim 1, wherein said binder is oxetane thermoplastic elastomer and the amount of binder in each formulation ranges from about five percent to about thirty percent by weight, based on the total weight of the propellant, said slow rate oxidizer is RDX and said fast rate oxidizer is CL-20, such that the ratio of respective burning rates is at least 2:1.

3. The method of claim 1, which includes the step of adding a second fast rate oxidizer to said fast rate formulation, said second fast rate oxidizer being selected from the group consisting of TNAZ, S-TNT, S-TNB, BTTN, TMETN, TEGDN, BDNPA/F, methyl NENA, ethyl NENA, and mixtures thereof.

4. The method of claim 1, wherein said layers are formed from ribbons, discs, cones, truncated cones and partial spheres.

* * * * *